US009351566B2

(12) United States Patent
Searer et al.

(10) Patent No.: US 9,351,566 B2
(45) Date of Patent: May 31, 2016

(54) SURE STOP LAZY SUSAN BEARING AND DETENT MECHANISM

(71) Applicant: FAS Industries, Inc., Elkhart, IN (US)

(72) Inventors: Floyd A. Searer, Elkhart, IN (US); Ralph N. Searer, Elkhart, IN (US); Vo Cong Hai, Hochiminh (VN)

(73) Assignee: FAS INDUSTRIES, INC., Elkhart, IN (US)

( * ) Notice: Subject to any disclaimer, the term of this patent is extended or adjusted under 35 U.S.C. 154(b) by 0 days.

(21) Appl. No.: 13/987,677

(22) Filed: Aug. 21, 2013

(65) Prior Publication Data

US 2015/0055905 A1 Feb. 26, 2015

(51) Int. Cl.
*A47B 49/00* (2006.01)
*A47B 63/00* (2006.01)

(52) U.S. Cl.
CPC ..... *A47B 49/006* (2013.01); *A47B 2063/005* (2013.01)

(58) Field of Classification Search
CPC .... A47B 49/00; A47B 49/004; A47B 49/006; A47B 81/002
USPC ..... 312/238, 257.1, 305, 125, 135, 197, 312/278; 108/103, 104, 105
See application file for complete search history.

(56) References Cited

U.S. PATENT DOCUMENTS

| | | | | | |
|---|---|---|---|---|---|
| 2,698,776 | A * | 1/1955 | Stoeckl | 312/238 | |
| 3,075,820 | A * | 1/1963 | Humphrey | 312/326 | |
| 3,281,197 | A * | 10/1966 | Anderson | 312/305 | |
| 4,146,280 | A * | 3/1979 | Crownhart | 312/305 | |
| 4,181,037 | A * | 1/1980 | Boon | A47B 49/006 | 108/105 |
| 4,433,885 | A * | 2/1984 | Baker | 312/305 | |
| 4,440,459 | A * | 4/1984 | Hallgren | 312/238 | |
| 4,587,908 | A * | 5/1986 | DeBruyn | 108/142 | |
| 5,169,220 | A * | 12/1992 | Herr et al. | 312/305 | |
| 6,089,167 | A * | 7/2000 | Frohardt | H05K 9/0067 | 108/142 |
| 2002/0117943 | A1* | 8/2002 | Gerkey | A47B 96/025 | 312/238 |
| 2006/0169187 | A1* | 8/2006 | Hoffman | A47B 49/006 | 108/103 |
| 2010/0206828 | A1* | 8/2010 | Gottschalk | A47B 96/025 | 211/144 |

* cited by examiner

*Primary Examiner* — James O Hansen
(74) *Attorney, Agent, or Firm* — B. Aaron Schulman, Esq.; Stites & Harbison, PLLC.

(57) ABSTRACT

A bearing and detent mechanism for automatic alignment of a Lazy Susan Turntable or shelf to an original position or door closed position is provided which includes a bearing mounted to the Lazy Susan Turntable and a cabinet shelf with a cavity on the outer bearing having an entrance and exit ramp and wherein the bottom of the exit and entrance ramp represents the detent or stop location of the Lazy Susan Turntable. The bearing and detent mechanism allows for the Lazy Susan Turntable to smoothly stop where it needs to so as to keep products on the shelf in a stable and upright position.

4 Claims, 14 Drawing Sheets

FIG. 13 (A-A)

Figure 15A shows a detail of the inner race and large cam of the Lazy Susan mechanism

46

SURE STOP LAZY SUSAN BEARING AND DETENT MECHANISM

BACKGROUND OF THE INVENTION

1. Field of the Invention

This invention relates to a device for the proper alignment of a Lazy Susan within a cabinet to its closed door position.

Lazy Susans mounted on steel and aluminum bearings have always relied on friction points to stop the Lazy Susan in the proper position. The standard industry detent uses a positioning tab that rubs against a contact point and then stops before passing a second contact point. If too much pressure is used, the positioning tab passes both contact points and does not stop at the detent position. Then the Lazy Susan is pushed in the opposite direction and the positioning tab rubs against the first contact point and hopefully stops before passing the second contact point and is then in the detent position.

Lazy Susans are sometimes mounted on steel and aluminum bearings which have built within them a means by which the return to the detent [position is achieved by a mechanism or device rather than by a manual force. The standard industry detent does not allow for Lazy Susana returned in this way to stop smoothly at the detent position, causing a rocking motion that can disrupt the contents of the Lazy Susan shelf and prevent it from fully stopping in the detent position.

2. Related Art

The related Art is that of the industry standard Lazy Susan detent mechanism described above.

SUMMARY OF THE INVENTION

The "Sure Stop" Detent of the invention is injection molded and incorporates a roller that is held against the outside of the present Lazy Susan bearing by a spring-loaded bracket. When a Lazy Susan shelf and bearing are returned to near the "door-closed" position of a cabinet by means of a manual force, a constant spring force or a cam spring combination force, the roller on the bearing reaches a ramp leading to the detent at the bottom of the ramp, the spring force on the roller pushes the roller down the ramp to the detent position, and the bearing stop where intended.

With the "Sure Stop" bearing and detent mechanism of the present invention the Lazy Susan only needs to be brought into close proximity of the detent location by means of manual manipulation, a constant spring force or a cam spring combination. Once the "Sure Stop" roller reaches the downward ramp on either side of the detent position on the bearing, it is pulled into the detent position and the bearing stops. The Lazy Susan is brought to, and held in, the door closed position, thereby eliminating the need for manual adjustment of the position of the Lazy Susan.

The "Sure Stop" bearing detent mechanism of the invention allows for the Lazy Susan to smoothly stop where it needs to, keeping the products on the shelf stable and in their upright positions. It also protects the cabinet door by more reliably stopping the Lazy Susan in the position that keeps it from interfering with, or connecting with, the cabinet door.

BRIEF DESCRIPTION OF THE DRAWINGS

FIG. 13 (A-A) represents a "Spring to View" with close up views of the Constant Force Spring and mount:

FIG. 15B shows the side view of the plastic Sure Stop detent bracket and provides the details of the spring engineering.

DETAILED DESCRIPTION OF THE INVENTION

Figure 1:
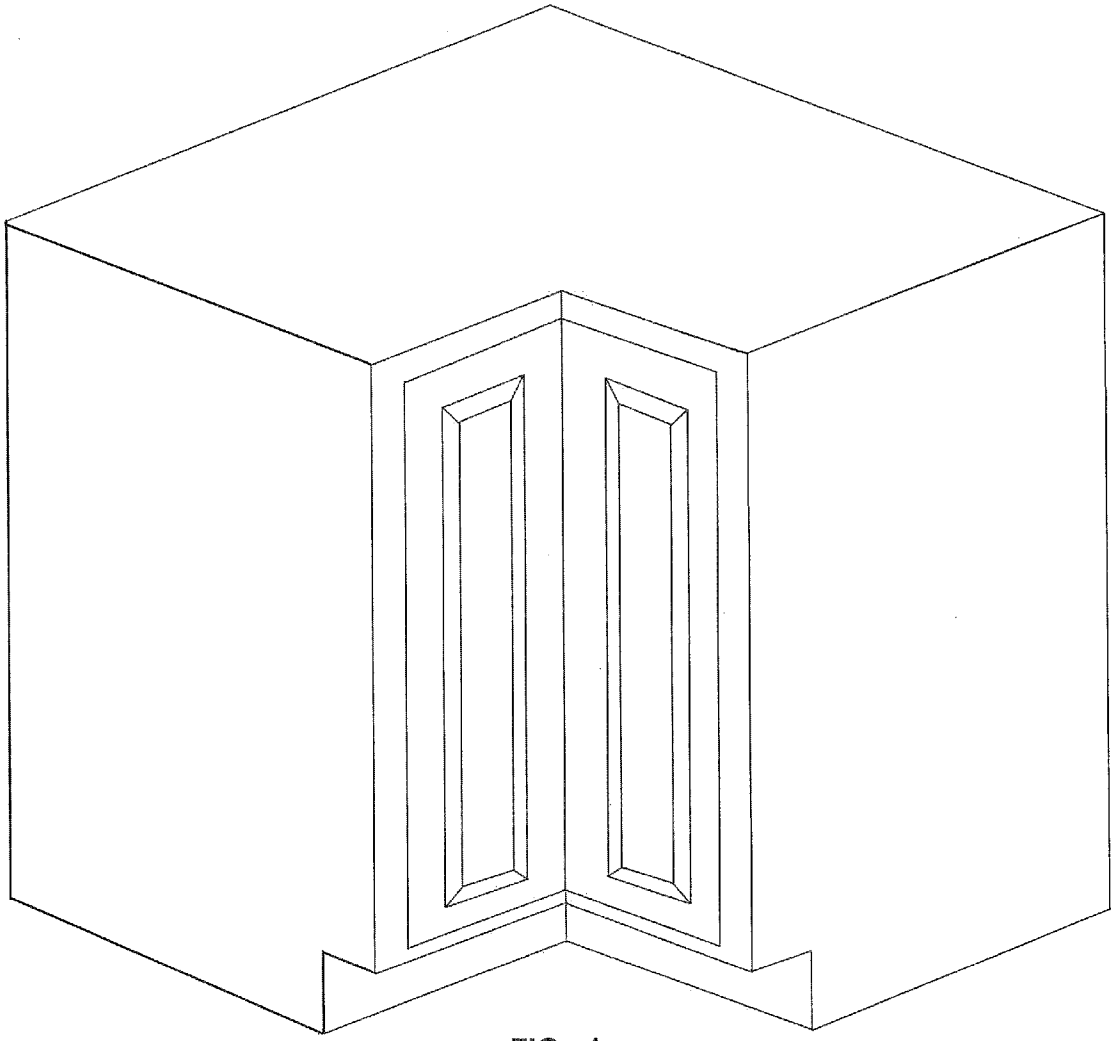
FIG. 1 illustrates a cabinet with the door closed.
Figure 1A:
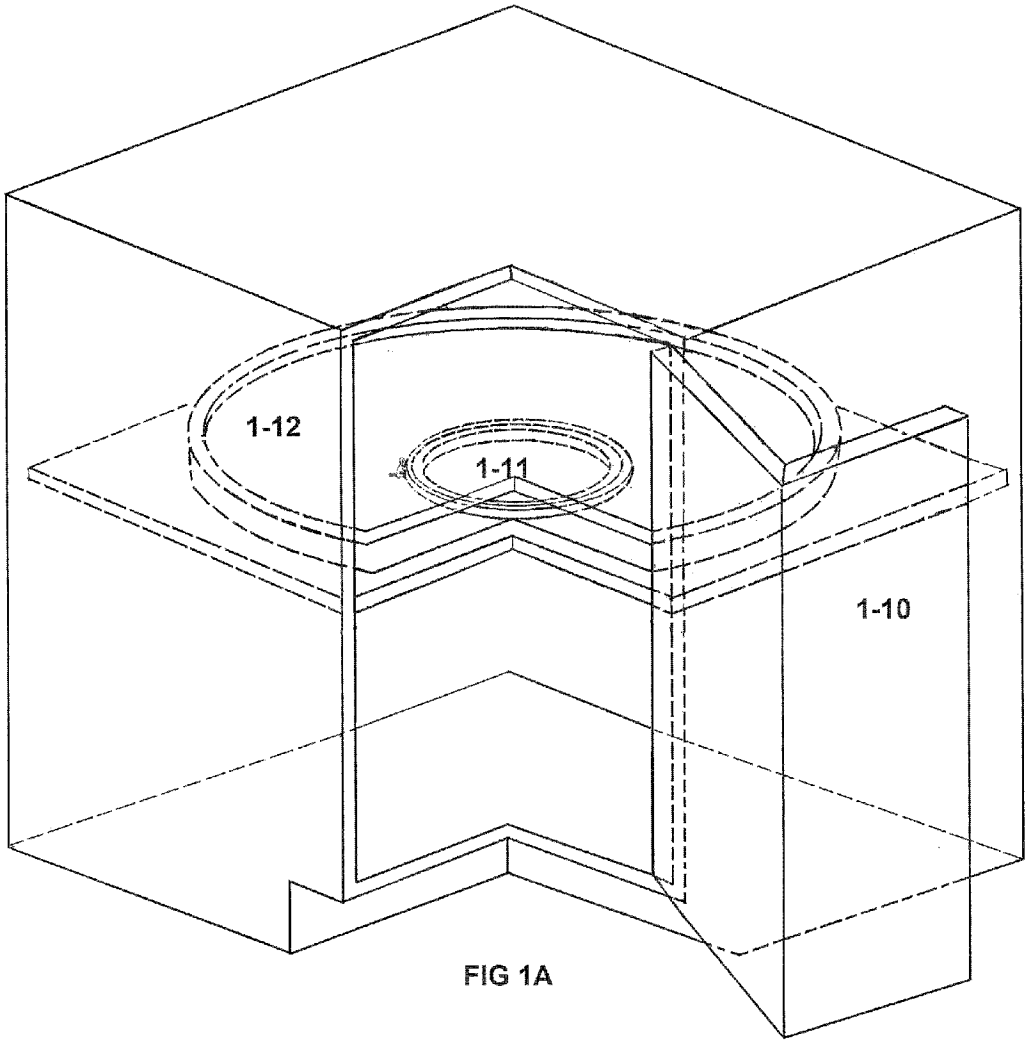
FIG. 1A shows the Lazy Susan cabinet with the Lazy Susan in the "door-closed" position and the door open.

In FIG. 1 a Lazy Susan cabinet is shown with the door closed. In FIG. 1A the Lazy Susan cabinet is shown with a Lazy Susan Shelf 1-12 correctly positioned by the Sure Stop Lazy Susan Bearing and Detent 1-11 to allow the door 1-10 to be closed without being impeded by the lazy Susan shelf 1-12.

Figure 2:
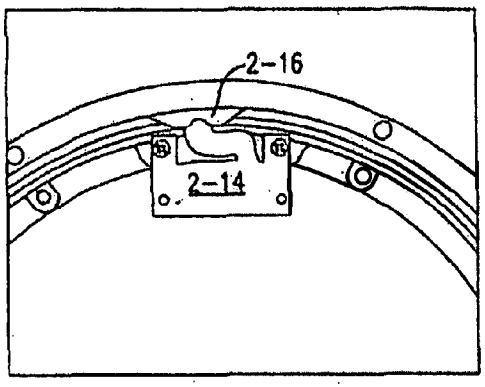
FIG. 2 PRIOR ART
FIGS. 2-4 show the operation of the detent mechanism employed by current industry standard Lazy Susan structures.
Figure 3:
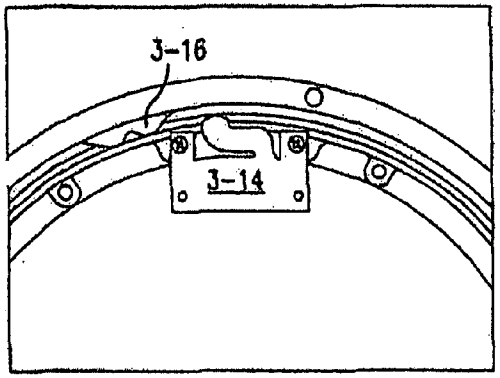
FIG. 3 PRIOR ART
Figure 4:
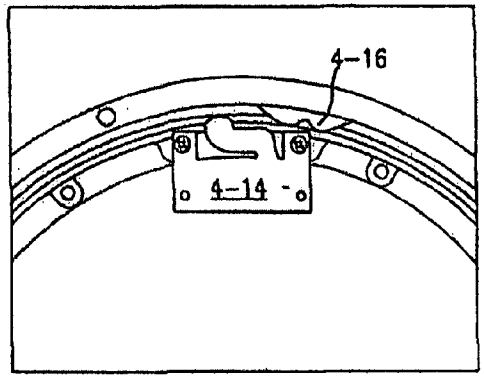
FIG. 4 PRIOR ART
Figure 5:
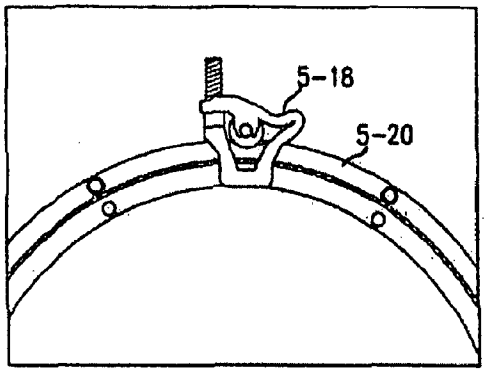
FIGS. 5-7 show the operation of the Sure Stop bearing detent mechanism of the present invention in accurately positioning the Lazy Susan structure at a desired location.
Figure 6:
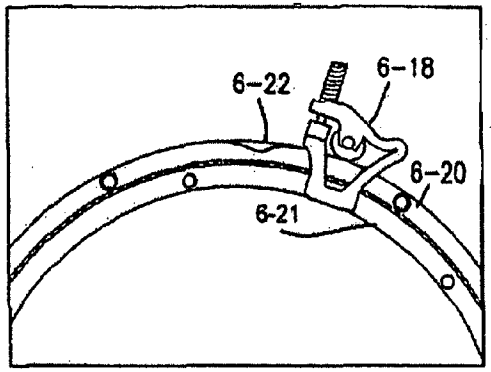
Figure 7:
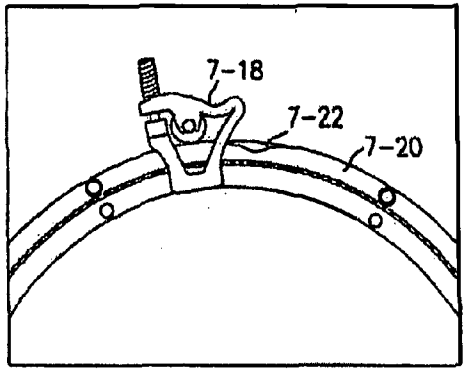

FIGS. 2-4 illustrate the operation of a standard industry bearing and detent wherein FIG. 2 shows the bearing and detent mechanism 2-14 locked in its desired position within detent 2-16. In FIG. 3 the bearing and detent mechanism 3-14 is outside of the detent 3-16 and in FIG. 4 the detent mechanism 4-14 is on the opposite side of the detent 4-16. A common problem with this standard industry bearing and detent mechanism is that the detent fails to engage the bearing, keeping it from properly positioning the Lazy Susan mechanism with respect to a door, or the like FIGS. 5-7 illustrate the operation of the "Sure Stop" Susan Bearing and Detent mechanism of the invention wherein FIG. 5 shows the "Sure Stop" mechanism 5-18 engaging the race 5-20 of the lazy Susan mechanism at the bottom of a ramp (not shown) on the race 5-20. In FIG. 6 the "Sure Stop" mechanism 6-18 is mounted on the race 6-21 outside the detent position 6-22. In FIG. 7 the "Sure Stop" mechanism 7-18 is shown mounted on the race 7-20 outside the detent position 7-22.

Figure 8:
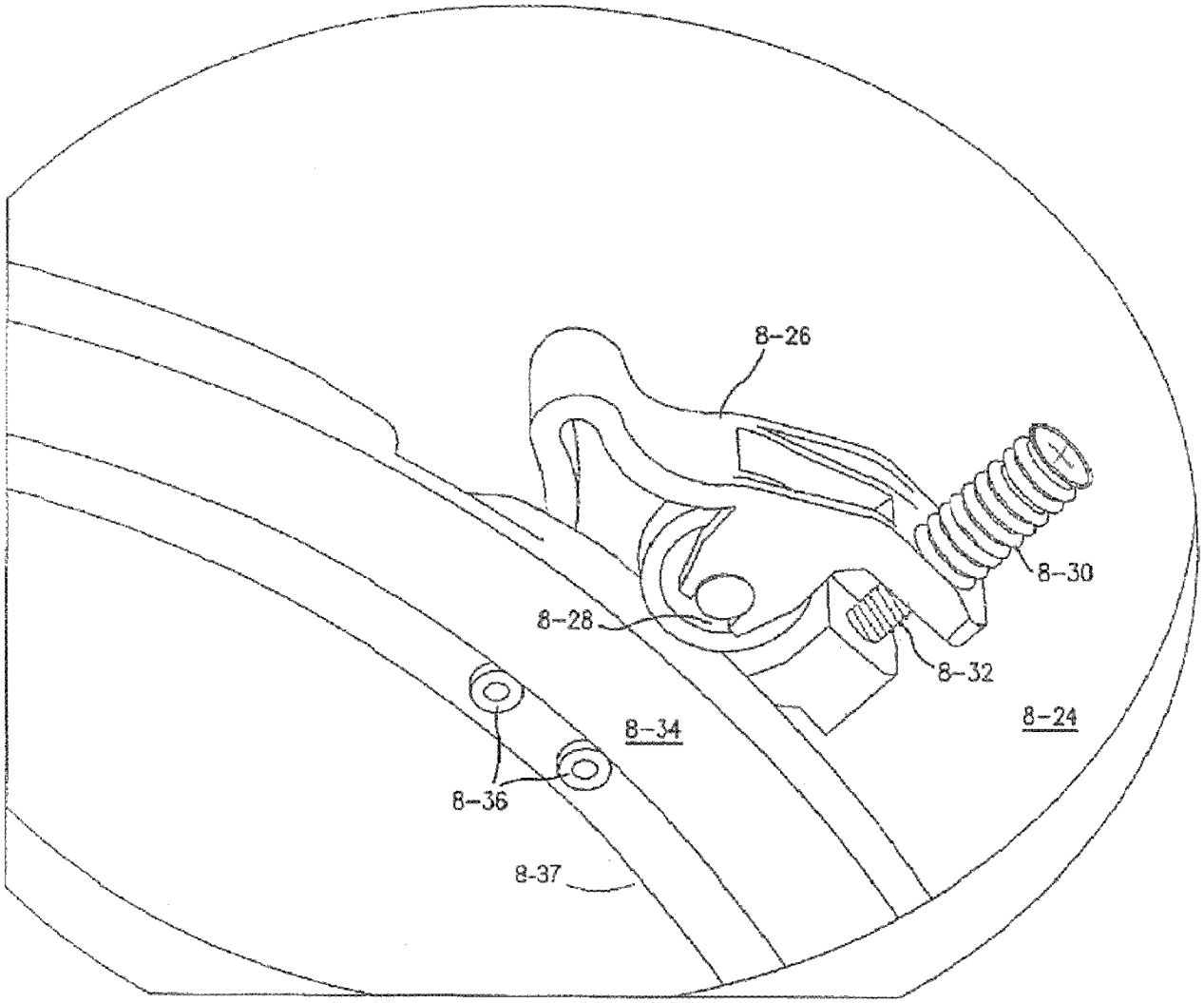
FIG. 8 shows the Sure Stop bearing and detent mechanism positioned along the outer bearing race.

FIG. 8 is a detail view of the "Sure Stop" bearing and detent mechanism 8-24 comprising a bracket 8-26, roller 8-28 biased by spring members 8-30 against the outside bearing race 8-34. Tension on spring member 8-30 can be adjusted by adjusting screw 8-32. The bearing and detent mechanism 8-24 is mounted to inner race 8-37 by snap-in mounting studs 8-36. Roller 8-28 presses against the outside of the race 8-34 as the race is rotated with respect to it.

Figure 9:
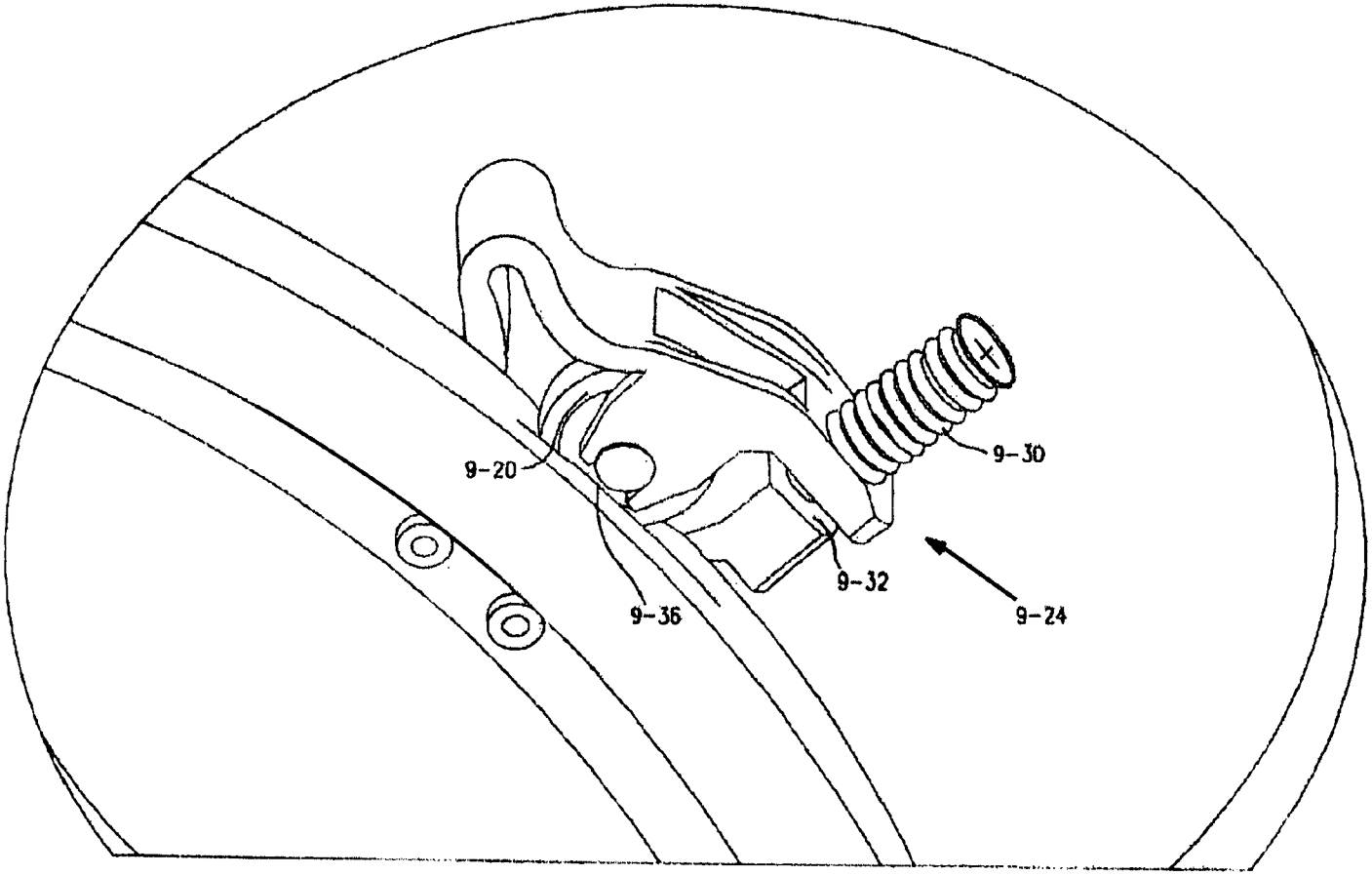
FIG. 9 shows the Sure Stop bearing and detent mechanism as it is positioned in the bottom of the ramp in the detent.

FIG. 9 shows the Sure Stop" mechanism engaging the bottom of a ramp 9-36 representing the proper detent position of the Sure Stop mechanism. Spring 9-30 is shown in a relaxed position and spring 9-32 is compressed thereby allowing the roller 9-20 to be engaged with the bottom of ramp 9-36 to be engaged with the bottom of ramp 36 representing the proper detent position of the Lazy Susan mechanism.

Figure 10:
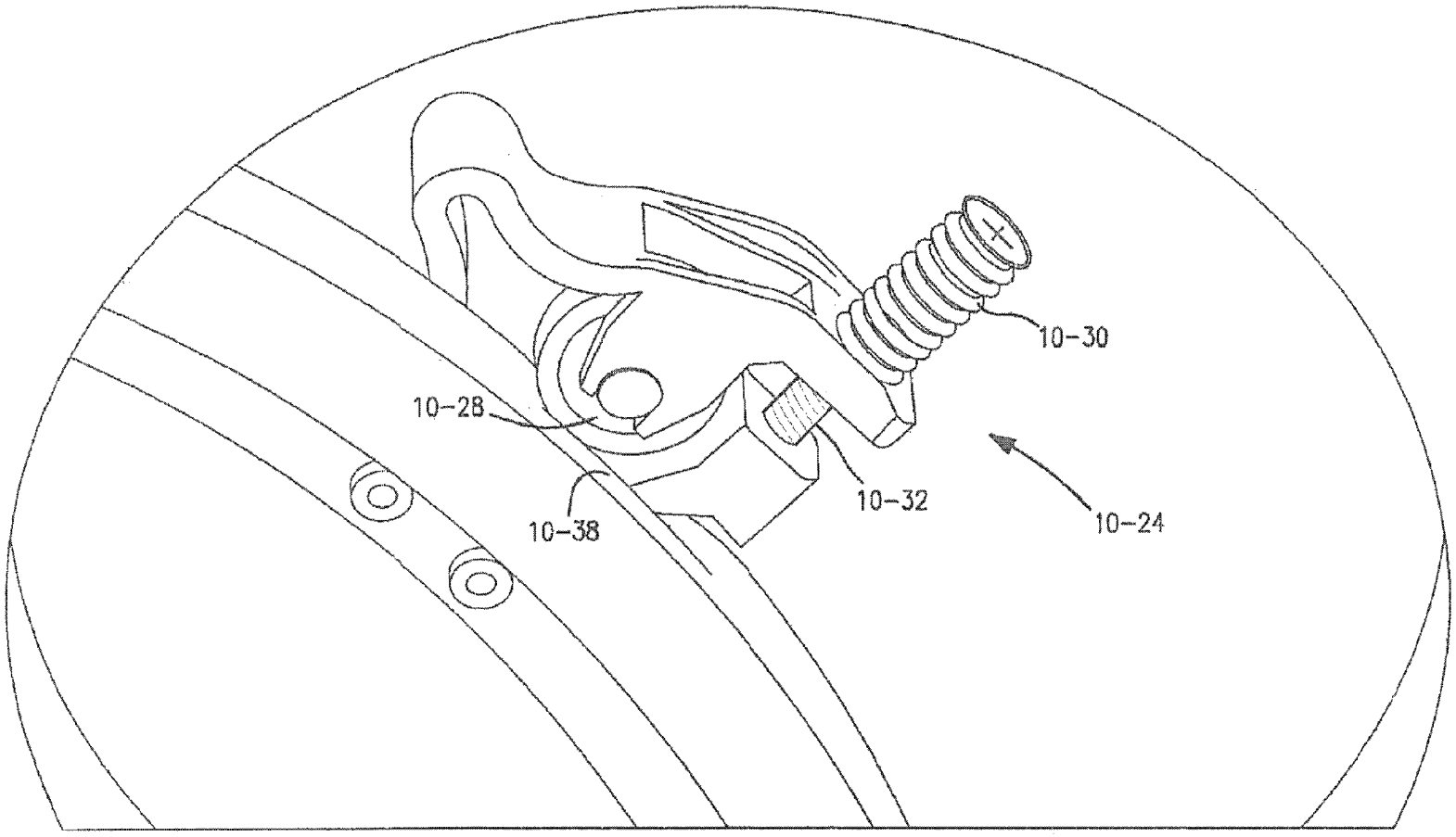
FIG. 10 shows the Sure Stop bearing and detent mechanism as it exits the detent position on the bearing race.

FIG. 10 shows the Sure Stop" mechanism 10-28 emerging from the detent ramp 10-38 with spring 10-30 compressed and spring 10-32 opened, thereby enabling the "Sure Stop" mechanism 10-24 to exit the ramp 10-38.

Figure 11:
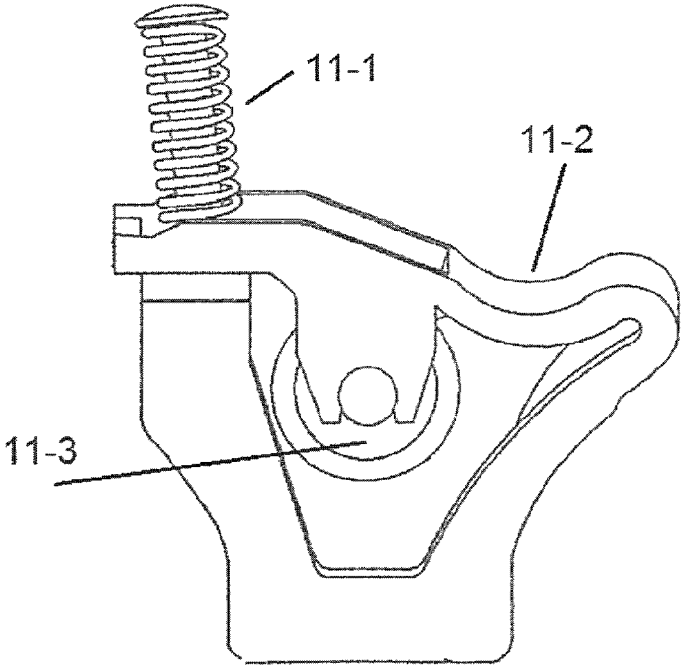
FIGS. 11 and 12 show respective front and back views of the Sure Stop detent mechanism.
Figure 12:
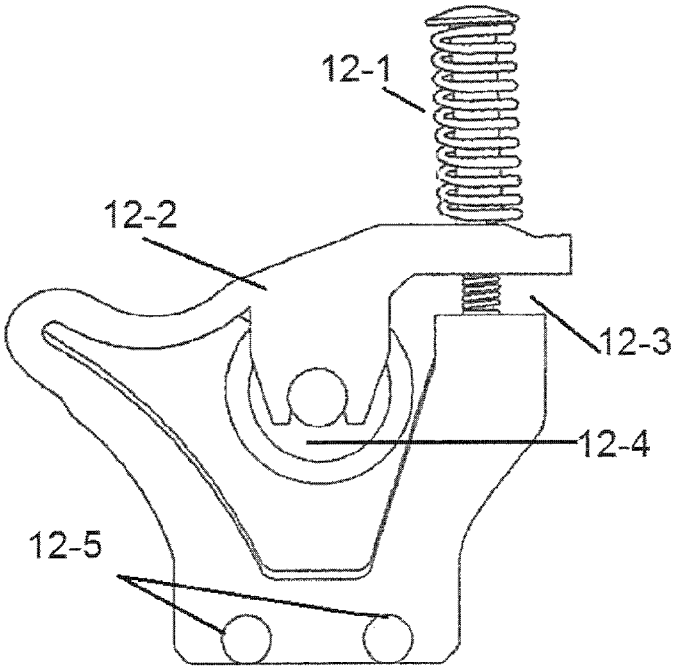

FIG. 11 shows the front of the Sure Stop Detent mechanism;

FIG. 12 is an injection molded mounting bracket which attaches to the bearing by way of studs 12-5. Attached to the mounting bracket are adjustment screw 12-3 which adjust the tension of the spring 12-1. Also attached to the mounting bracket is roller 12-4 which allows for the detent to smoothly travel along the race of the bearing when it is moving.

Figure 13:
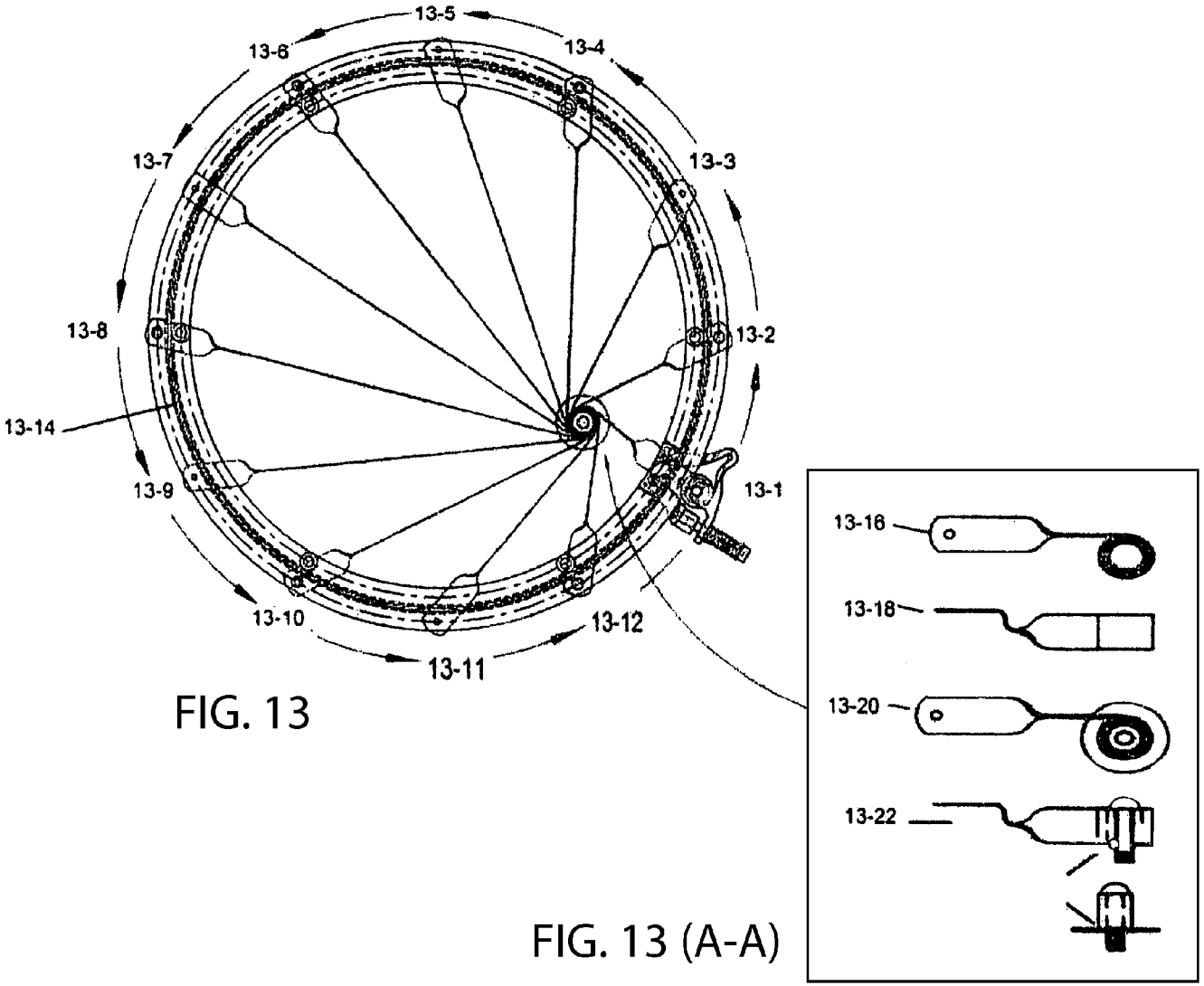
FIG. 13 shows the outer bearing, different positions of the spring mechanism pulling the turntable of the Lazy Susan back to a neutral position.

FIG. 13 shows the Mounted Sure Stop Detent 13-1 which is the primary focus of the subject non-provisional patent application. Springs 13-2 thru 13-12. (as noted on FIG. 13) are shown in different positions as outer bearing 13 is rotated. It is noted that the positions of springs 13-2-13-12 are only representative positions of the springs as the return mechanism operates with an almost infinite number of positions on the turntable." The invention does not contemplate only one hub with twelve different springs coming from it, so the structure and function of these twelve cannot be defined as they are merely illustrative.

FIG. 13 (A-A), represents a Close up views of Constant Force Spring and mount of the constant force spring 13-16 which is the end that mounts to the bearing 13-4, allowing the spring 13-16 to stay attached to a single point on the bearing as the bearing is rotated. As the bearing is rotated, the spring extends. Once the bearing is started back to the "door closed" position, the spring compresses and "pulls" the bearing back around to the detent position.

FIG. 13-18 (A-A) shows a side view of the spring top view 13-16.

FIG. 13-20 (9A-A) is the same as FIG. 13-16 except it shows the constant force spring mounted to the spindle that is anchored to the turntable on which the bearing is mounted or to a bracket affixed to the bottom race of the bearing;

FIG. 13-22 (A-A) is a top view of FIG. 13-20 (A-A).

Figure 14:
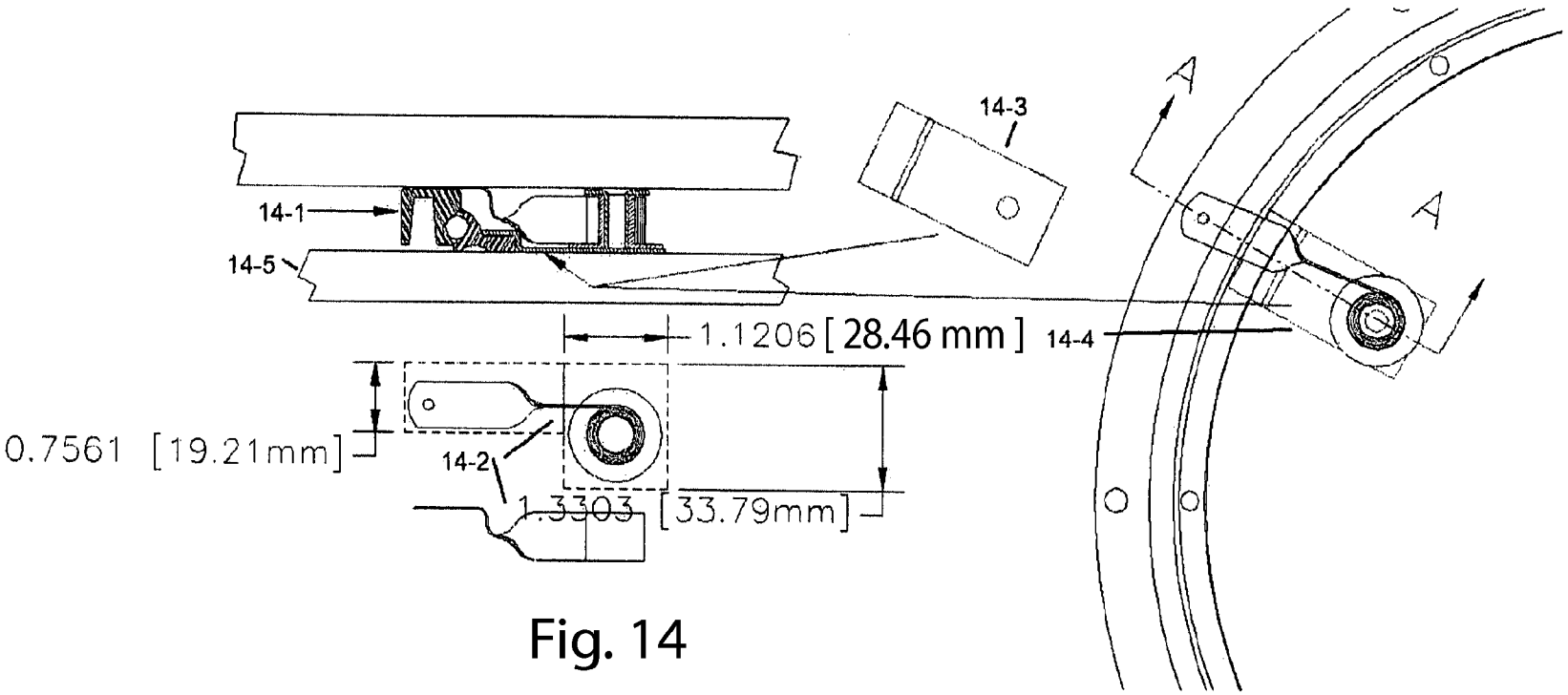
FIG. 14 shows a detailed top view of the constant force spring attached to the spindle on one end and attached to the out race of the bearing on the other end.

FIG. 14 shows a plastic spindle on which the constant force spring is mounted. This spindle is held in a stationary position to the turntable or to a bracket affixed to the bottom race of the bearing. One end of the constant force spring is attached to the spindle so that the end of the spring is in place as the length of the spring is extended as the turntable is rotated. A close up of the spring 14-2 attached to the bearing 14-1 and shelf 14-5 by means of a spindle 14-4 mounting plate 14-3 is depicted on FIG. 14.

Figure 15:
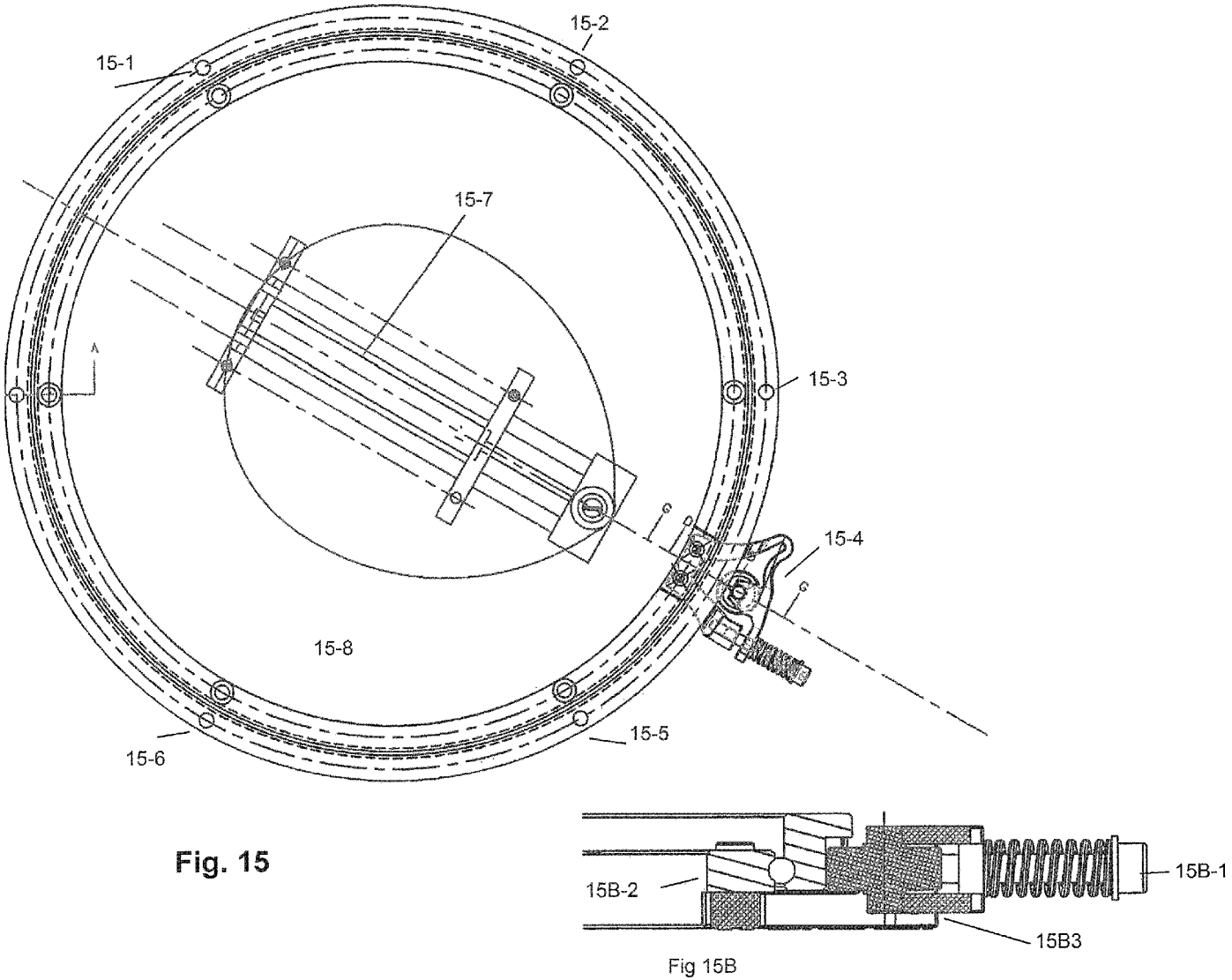
FIG. 15 shows the Sure Stop Detent mounted to a bearing utilizing the Cam and Gas Spring method of automatic return.
Figure 15A:
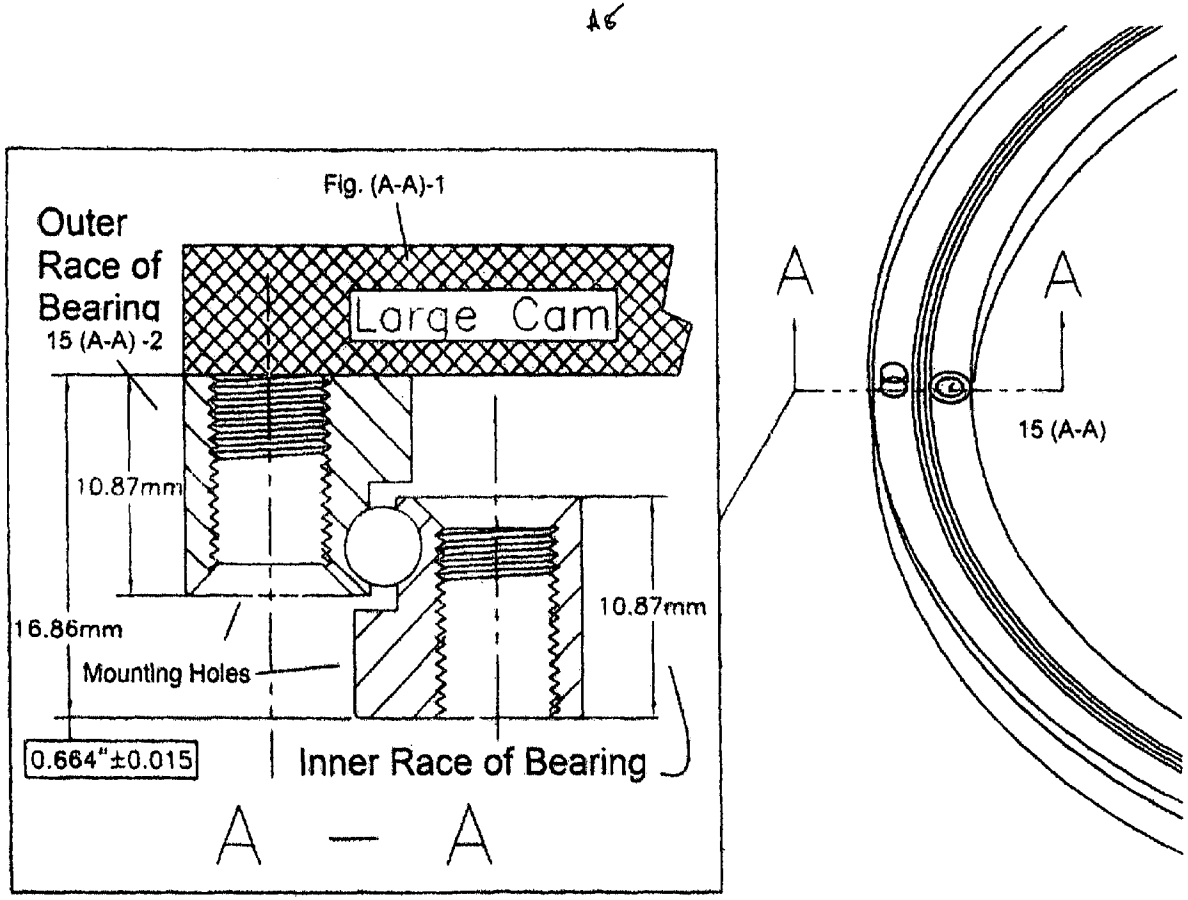
FIG. 15A shows a detail of the inner race and large cam of the Lazy Susan mechanism.

With respect to FIG. 15, mounting holes 15-1 are used on the outer race 15-9 to allow for the outer race to attach to the Lazy Susan shelf to the bearing. Mounting holes 15-2, 15-3, 15-6 and 15-5 are the same as mounting hole 15-1.

FIG. 15 shows the Sure Stop Detent mounted to a bearing utilizing an automatic cam and spring return mechanism. The Sure Stop Detent allows for the smooth return of a turn table to its door-closed position.

Gas Spring 15-7 is a type of spring that uses compressed gas, that is contained in a cylinder and compressed by a piston to exert a force. As the turntable turns, the spring is extended. Once the turntable is started back to the door closed-detent position, the spring retracts smoothly.

In FIG. 15, large cam 15-8 is attached to the outer race of the bearing. The spring (Ref#) is attached to the outer race of the bearing. The spring engages against the cam to return the bearing to the door-closed position where it is smoothly stopped and held in place by the Sure Stop Detent 15-4. Cam 15-8 can be made of a variety of materials, such as plexiglass or metal. The amount of pressure within the spring and the diameter of the cam opening will determine the point at which the bearing will return.

In FIG. 15B-1, 2 identifies the side view of the Sure Stop Detent in an engaged position. In FIG. 15B-1 the spring that is shown in FIGS. 8-30, 9-3- and 10-30. FIG. 15B-2 shows the inner race of the bearing (side view) and 15B-3 shows the side view of the plastic Sure Stop Detent bracket.

Figure 16:
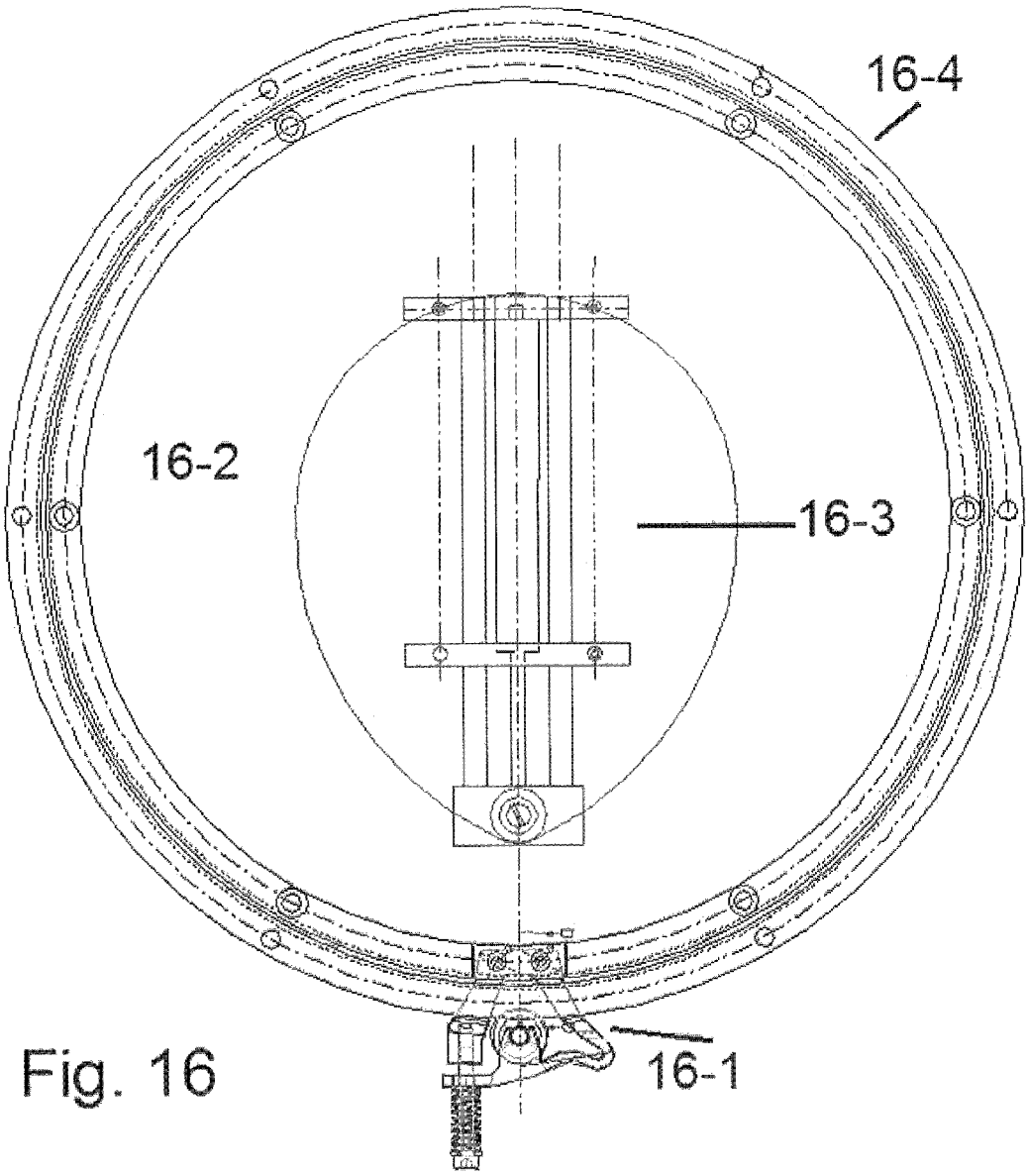
FIG. 16 shows a bearing with a cam and spring return mechanism.

FIG. 16 shows a bearing 16-4 using the cam 16-2 and spring 16-3 return mechanism with the Sure Stop Detent 16-1 in the door-closed position. Spring 16-3 is compressed to its neutral or door-closed position.

Figure 17:
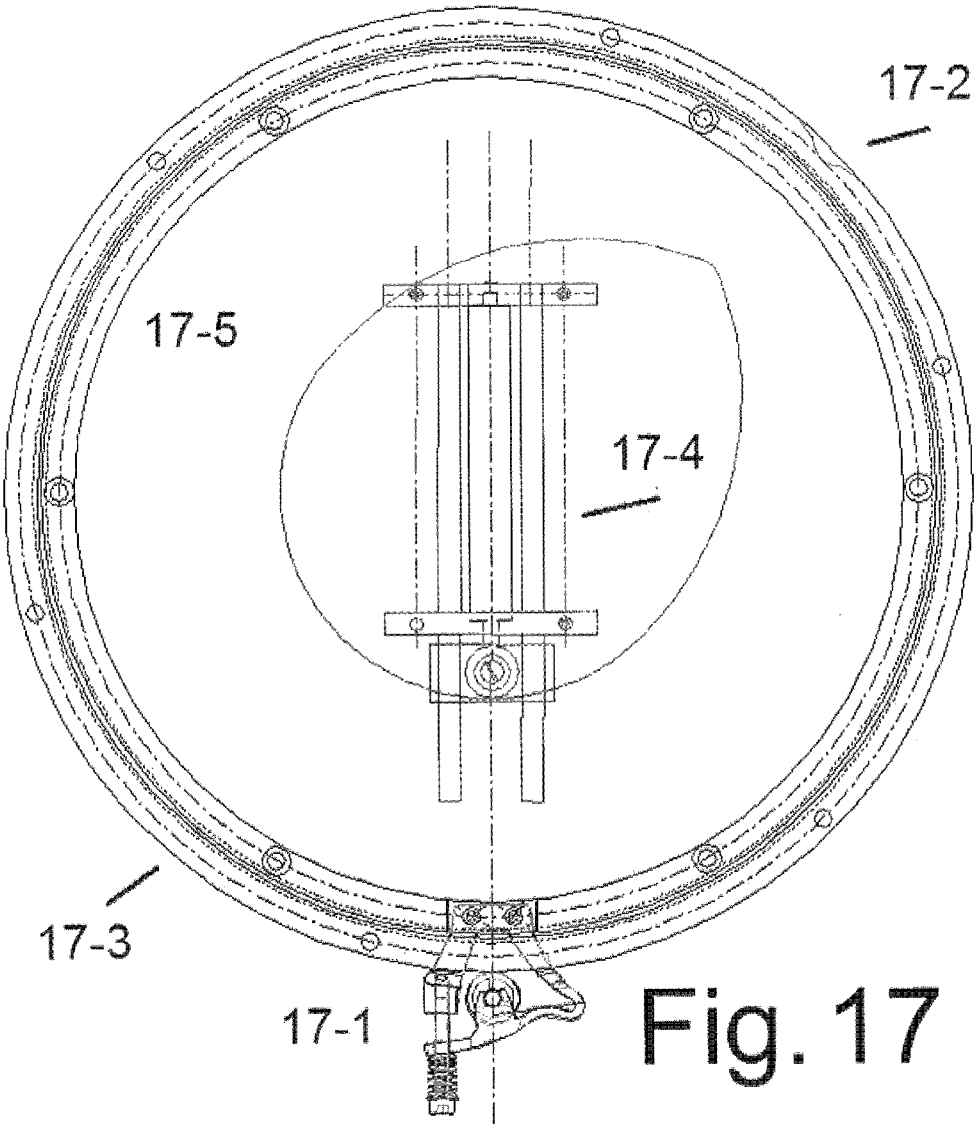
FIG. 17 shows a bearing using a cam and spring return mechanism.

FIG. 17 shows a bearing 17-3 using the cam 17-5 and spring 17-4 return mechanism with the Sure Stop Detent 17-1. The Sure Stop Detent has disengaged from the detent ramp 17-2, allowing for the bearing to move freely as it rotates. As the bearing is brought to the door-closed position the Sure Stop Detent will engage with the Detent Ramp, allowing the turntable to stop smoothly in the door-closed position.

Figure 18:
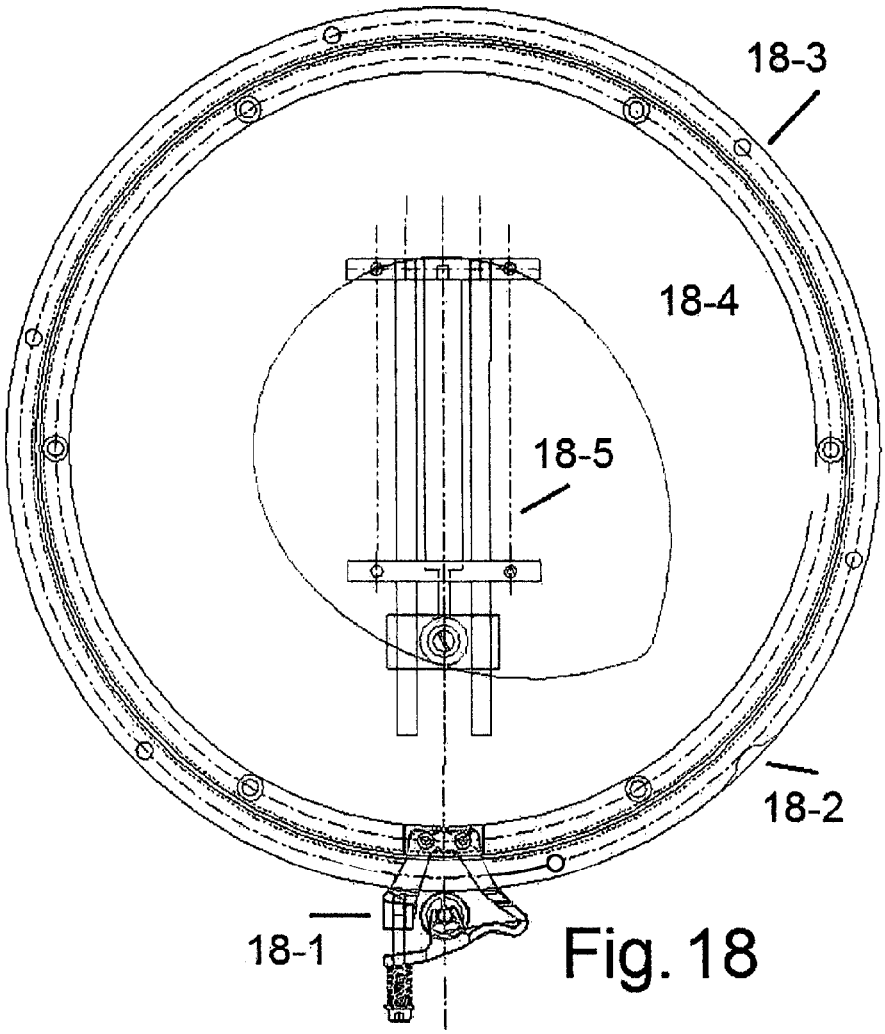
FIG. 18 shows a bearing and spring return mechanism.

FIG. 18 shows Bearing 18-3 using the cam 18-4 and spring 18-5 return mechanism with the Sure stop Detent 18-1. The detent ramp i8-2 is nearing the Sure Stop Detent 18-1 which will allow the bearing to stop smoothly in the door-closed position.

Thus in accordance with the invention, the "Sure Stop" mechanism only needs to be brought close to the detent location. Once the "Sure Stop" roller reaches the downward ramp on the bearing (race) it is pulled into the detent position and the outer bearing (race) stops. The "Sure Stop" mechanism of the invention eliminates manual adjustment of the Lazy Susan attached to the bearing.

The invention claimed is:

1. A bearing and detent mechanism for automatic alignment of a Lazy Susan Turntable or shelf to an original position or door closed position, comprising:

a bearing comprising an outer race and an inner race, wherein said inner race is movable relative to the outer race, said bearing mounted to a Lazy Susan Turntable or shelf, said outer race having an entrance and exit ramp having a bottom cavity situated along the outer circumference of said outer race wherein said bottom cavity of the exit and entrance ramp represents a detent or stop location of the Lazy Susan Turntable or shelf;

a bracket attached to said inner race of said bearing and having a spring-loaded roller engaging the outside surface of the outer race of said bearing, so that upon manual rotation of the Lazy Susan Turntable or shelf clockwise or counter-clockwise near to an original starting position or door closed position, the engagement of said roller with said exit and entrance ramp causes said roller to move along the outer circumference of said outer race until it reaches the entrance and exit ramp and then moves downward in order to engage the bottom cavity of said entrance and exit ramp to correctly stop the Lazy Susan Turntable or shelf at its desired location.

2. A bearing and detent mechanism for automatic alignment of a Lazy Susan Turntable or shelf as in claim 1, further comprising a gas spring and cam mechanism for returning the Lazy Susan Turntable or shelf near to an original starting position or door close position, the engagement of said roller with said entrance and exit ramp causes said roller to engage the bottom of the cavity to correctly stop the Lazy Susan Turntable or shelf at its desired location.

3. A bearing and detent mechanism for automatic alignment of a Lazy Susan Turntable or shelf as in claim 1, further comprising a constant force spring mechanism for returning the Lazy Susan Turntable or shelf near to an original starting position or door close position, the engagement of said roller with said entrance ramp causes said roller to engage the bottom of the cavity to correctly stop the Lazy Susan Turntable or shelf at its desired location.

4. A bearing and detent mechanism for automatic alignment of a Lazy Susan Turntable or shelf as in claim 1, further comprising a spring mechanism selected from the group consisting of a constant force spring, normal spring, elastic bands and a cam and spring combination which can be used to provide the necessary restorative force to return the Lazy Susan Turntable or shelf to a given original position.

* * * * *